United States Patent [19]

Hamilton

[11] 4,114,233

[45] Sep. 19, 1978

[54] WINDOW TRIM ASSEMBLY

[75] Inventor: Gerald A. Hamilton, Skillman, N.J.

[73] Assignee: Val-Trac Incorporated, New York, N.Y.

[21] Appl. No.: 783,236

[22] Filed: Mar. 31, 1977

Related U.S. Application Data

[63] Continuation-in-part of Ser. No. 730,411, Oct. 7, 1976, abandoned.

[51] Int. Cl.[2] ..... A47H 1/04

[52] U.S. Cl. ..... 16/95 R; 160/38

[58] Field of Search ..... 16/95 R, 95 DW, 95 W, 16/95 D, 87.4, 94; 160/19, 38, 39, 172; 248/267, 252

[56] References Cited

U.S. PATENT DOCUMENTS

| | | | |
|---|---|---|---|
| 3,297,075 | 1/1967 | Howell et al. | 160/38 |
| 3,574,887 | 4/1971 | Schindlauer | 16/95 D |

FOREIGN PATENT DOCUMENTS

| | | | |
|---|---|---|---|
| 796,077 | 10/1968 | Canada | 16/95 R |

*Primary Examiner*—Ronald Feldbaum

*Attorney, Agent, or Firm*—Burgess, Dinklage & Sprung

[57] ABSTRACT

Window trim assembly of extruded plastic sections for mobile homes and the like, having a rear mounting base member and a front member having shade, drapery or valance mounting formations which is releasably coupled to the base member. The mounting base member has a base panel to be mounted against a building wall and an outwardly projecting mounting rib to be interfitted in a channel recess of the front member and held therein by interlocking teeth. Side jamb sections and a bottom section can be added.

19 Claims, 12 Drawing Figures

16
11
3
17
45
41
12
47
49
48
15
41
40
28
16
41
37
52
13
49
18
14
19
54
55
20
38
59
3
54
10

FIG. 6a.
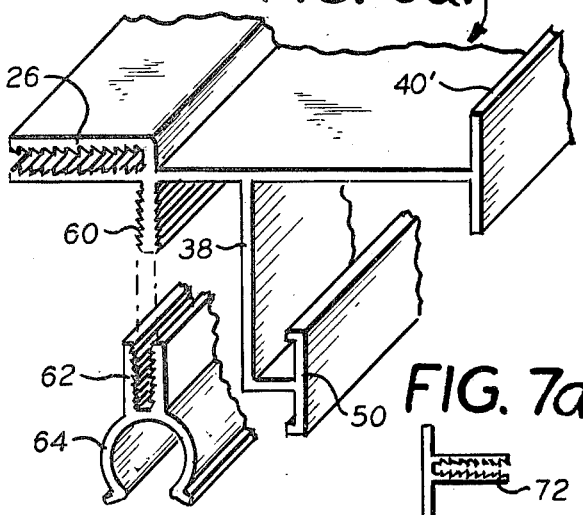
FIG. 6b.
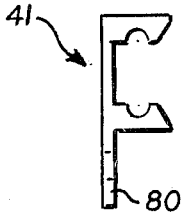
FIG. 6c.
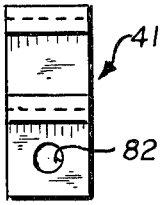
FIG. 7a.
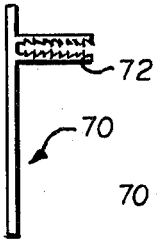
FIG. 7b.
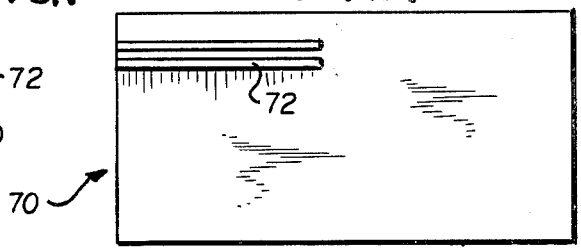
FIG. 8a.
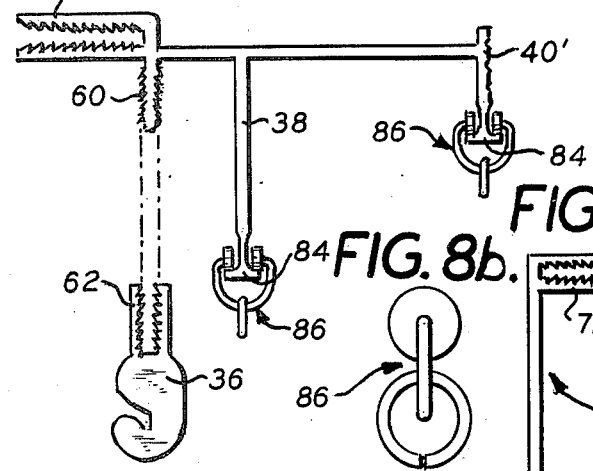
FIG. 7c.
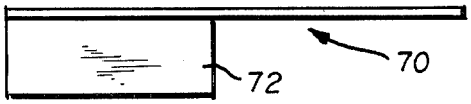
FIG. 8b.
FIG. 8c.
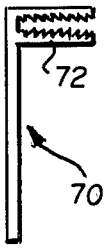
FIG. 8d.
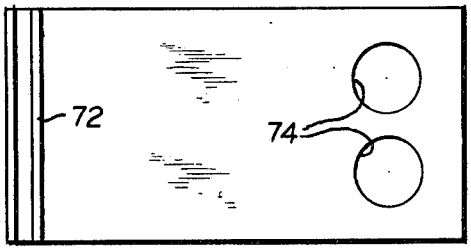
FIG. 9a.
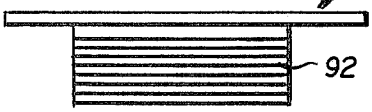
FIG. 9b.
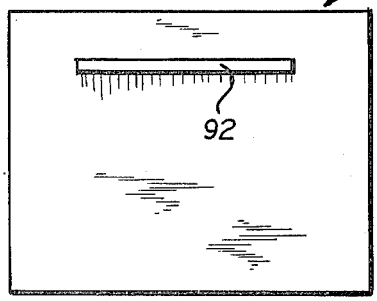
FIG. 9c.
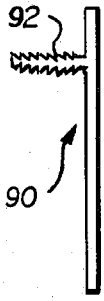
FIG. 10.
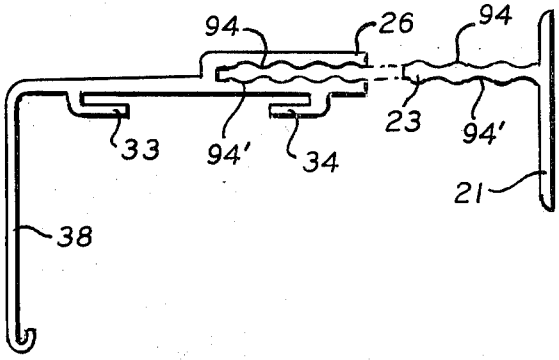

WINDOW TRIM ASSEMBLY

RELATED APPLICATION

This application is a Continuation in Part of my copending application Ser. No. 730,411 filed Oct. 7, 1976 for "Window Trim Assembly" and now abandoned.

BACKGROUND

The present invention relates in general to trim structures for window openings and the like, and more particularly to a trim structure, preferably formed from extruded plastic, for mobile homes, industrial homes and similar low cost home installations, wherein the trim structure can provide a combination shade mounting drapery or valance supporting head and can also provide shade receiving channels in side jamb portions to enable the assembly to function as an energy saving thermal barrier for a window opening.

In low cost home constructions such as mobile homes, and similar industrialized or prefabricated type homes, it has been the predominant practice to utilize lumber or plywood to form the frames for window openings and the trim about the window openings. Most known window trim as customarily produced requires a considerable amount of labor and time to install. The trim must be nailed to the intersecting surfaces of window frames and to the wall surrounding the frame. Nail holes should be puttied and the trim precisely fitted to conform to the structured frame. If the windowsill or window opening is not completely plumb or squared, a much greater amount of time and labor is required to trim the frame. Frequently the window jambs, if formed of plywood or low cost lumber, may have jagged edges which can damage clothing and injure individuals who accidentally brush against the jambs. Milled lumber and plywood jambs and window trim have the additional disadvantage of the finishing cost involved in sanding and painting the jamb and trim sections. Additionally, the jambs and trim must be periodically painted which represents an undesirable maintenance cost.

Furthermore, if it is desired to provide roller shades and draperies or valances for the window opening, suitable hardware for supporting the roller shade must be separately mounted and precisely positioned on the head trim member and the drapery supporting hardware must also be separately installed. A typical construction of this type is shown in U.S. Pat. No. 2,449,597 to Ferrenberg, issued Sept. 21, 1948. All of these involve additional labor and maintenance expense.

Two-piece curtain or drape rods have been proposed by U.S. Pat. No. 2,705,566 to Ford et al. issued Apr. 5, 1955 and U.S. Pat. No. 3,818,544 to Helmer et al. issued June 25, 1974. While these constructions simplify installation somewhat, they do not avoid the cumbersome use of conventional fasteners such as nails, screws and bolts for mounting the curtain or drape supporting member and they are limited functionally.

The present invention provides a window trim assembly preferably of extruded plastic which is inexpensive and simple and may be cut to desired length and mounted against the inside or outside wall surface of a building wall to form a trim about window openings in mobile and conventional homes and industrialized or prefabricated homes and the like, providing a strong rigid window trim structure which is simple to install and minimizes maintenance expense. The assembly also forms an effective energy saving thermal barrier for window openings of all kinds.

The present invention provides a window trim assembly having a head trim member providing shade mounting and drapery or valance supporting facilities and preferably jamb members having channels for receiving and forming guides for the edges of roller shades and the like thus improving the light stopping and thermal characteristics of the assembly when a shade mounted therein is drawn down to closed position on the exterior or interior of a window opening.

SUMMARY

The window trim assembly of the invention includes a mounting base member and a front head trim member attached thereto. The mounting base member has a flat base portion which is vertically positioned and mounted against a window frame head or wall. The base member also has a flat mounting rib portion integral with the base portion and projecting forwardly and horizontally therefrom. The front head trim member has a generally flat main body panel portion positioned in a horizontal plane and adapted to support valance, shade or curtain mounting elements. The head trim member terminates along its rearward edge in a rearwardly opening channel having means therein for gripping the mounting rib portion of the mounting base portion in interlocked relation when inserted therein.

In a preferred embodiment the mounting rib portion of the mounting base member has a series of ridges extending along parallel paths along the length thereof and the inner facing surfaces of the channel of the front head trim member has a similar configuration extending along parallel paths along the length thereof to interlock with the ridges of the mounting rib portion when the latter is inserted in the channel. The ridged can be saw-toothed or rounded in shape to provide for a permanent or releasable interlock. The saw-tooth configuration can be separated by laterally sliding the parts apart and the rounded configuration can simply be pulled apart.

The channel sides are slightly flexible so as to allow separation of the channel sides during insertion of the mounting rib portion and interlocking of the confronting ridges of the mounting rib and the channel interior.

DESCRIPTION OF THE DRAWINGS

FIG. 6*a* is a perspective end view partly broken away of an alternate embodiment with respect to the front member of the head assembly and FIGS. 6*b* and *c* are side and front views of a slide clip for use with the front member of FIG. 6*a;*

FIGS. 7*a–c* are end, front and top plan views of an end cap member designed for use with the front member of FIG. 6*a;*

FIGS. 8*a* and *b* are side views of a further embodiment of the front member of the assembly;

FIGS. 8*c* and *d* are side and front views of an end cap member for use with the front member of FIG. 8*a;*

FIGS. 9*a–c* are top, front and side views of an end cap suitable for use with the embodiment of FIGS. 1–5 and 10;

FIG. 10 is a side view of a further embodiment of the window trim assembly which is especially suited for releasably mounting thermal see-through shade on the exterior of a window opening such as in a recreational vehicle;

DESCRIPTION

Figure 1:
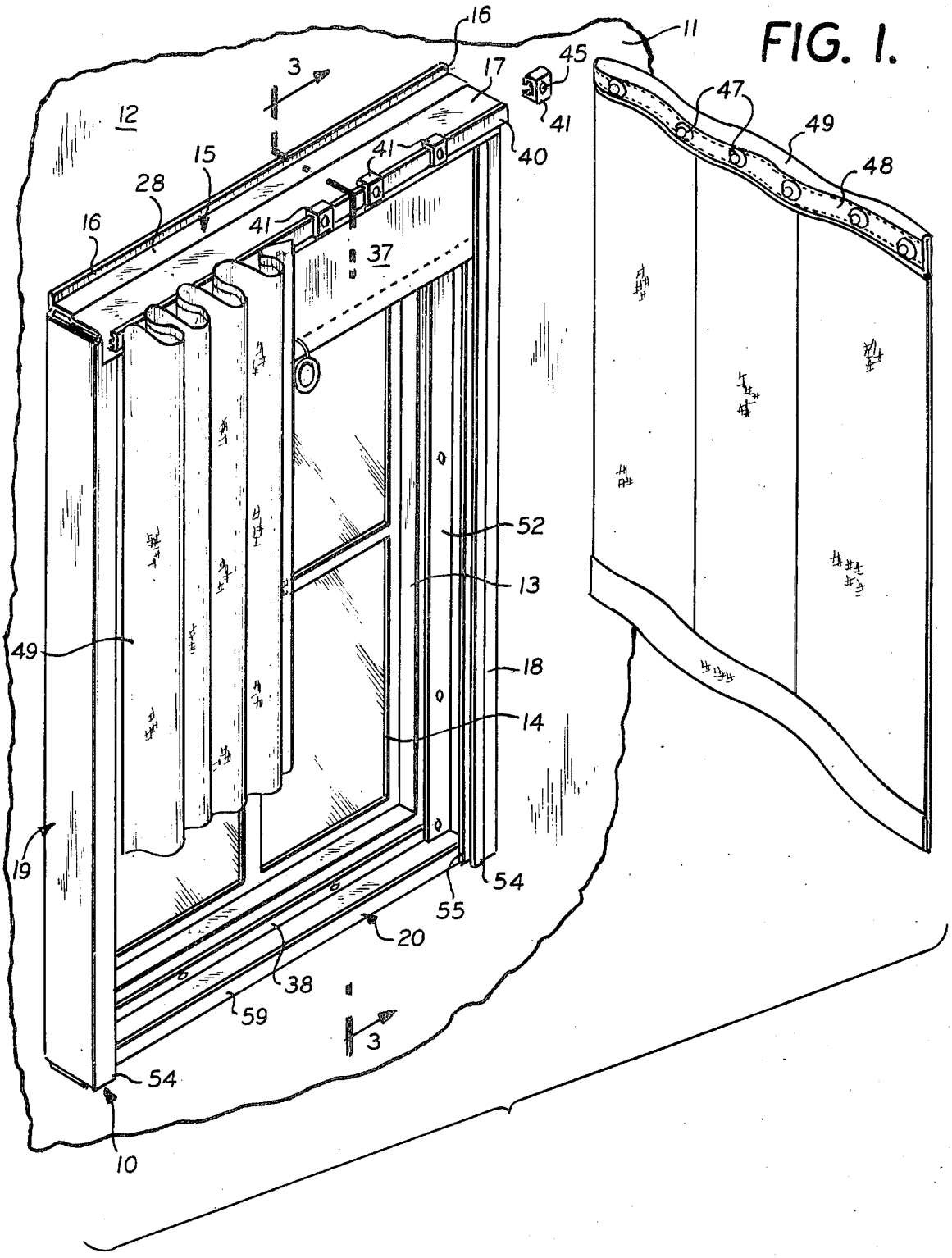
FIG. 1 is a front perspective view of the window trim assembly of the invention shown mounted on a fragmentary portion of a building wall surrounding a window, and with one of a pair of draperies shown in exploded relation thereto.

Referring to the drawings, wherein the preferred plastic extrusion embodiment is shown and like reference characters designate corresponding parts throughout the several figures, the plastic window trim of the invention is indicated generally by reference numeral 10 in FIG. 1 and is shown in assembled condition mounted on the inner wall surface 11 of a building wall 12 having a window opening 13 therein occupied by a window sash 14 which may be either stationary or movable as desired. As previously stated, the window trim assembly 10 of the invention is particularly designed to provide a decorative inside trim for windows in mobile homes, industrialized or prefabricated homes or building wall sections, particularly for low cost building installations, and may also be readily used in remodeling or redecorating existing building installations of conventional types. It will be appreciated, however, that the plastic window trim assembly is not limited to these applications but may be used as decorative trim for window or door openings whereever they may occur in building structures or the like and may be used as a complete rectangular frame trim assembly or parts thereof may be used to frame or partially frame wall recesses, bookcases, wall hung pictures, or other applications where it may be desired to provide movable drapes which can be selectively drawn to closed condition to cover a wall area or opened to reveal the same.

As shown in the drawings, the plastic window trim assembly 10 is formed of a head trim section 15 forming the top horizontal member of the rectangular trim frame and made up of two head trim components 16 and 17 each preferably formed of extruded plastic or metal sections of uniform cross section throughout their length which may be readily cut to whatever length may be needed to properly trim the size window opening about which it is being installed. The vertical elongated side or jamb trim members 18 and 19 are preferably formed of extruded plastic or metal sections of uniform cross-sectional configuration. The bottom or sill trim member 20 is also formed preferably of a plastic or metal extrusion of uniform cross section throughout its length having a slightly different cross-sectional configuration from the side or jamb trim members 18, 19 but designated to cooperate and interfit therewith.

Figure 2:
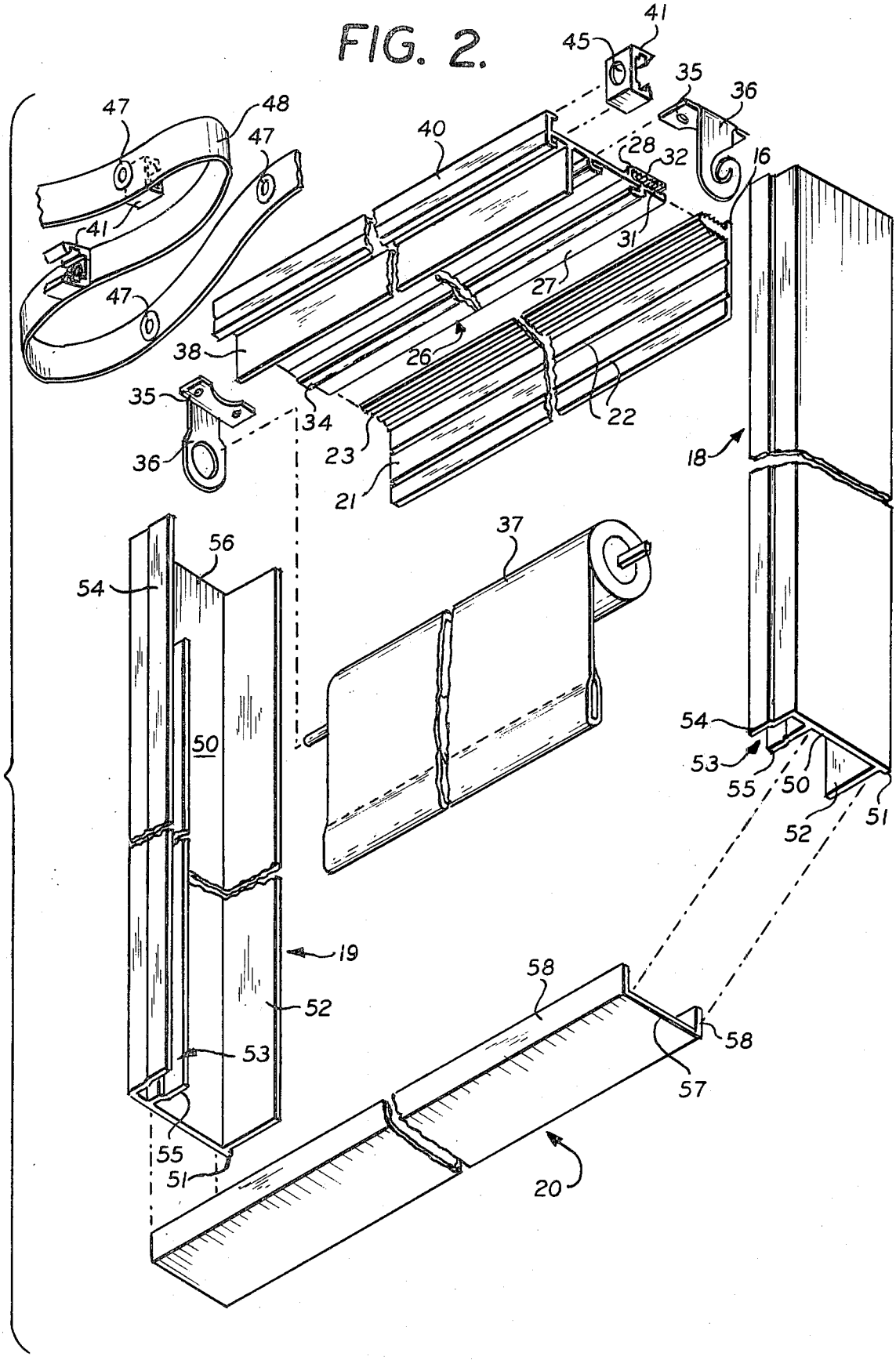
FIG. 2 is an exploded front perspective view of a window trim assembly of the invention, and showing a suitable drapery supporting tape and slide members and shade bracket components adapted to be used therewith.
Figure 3:
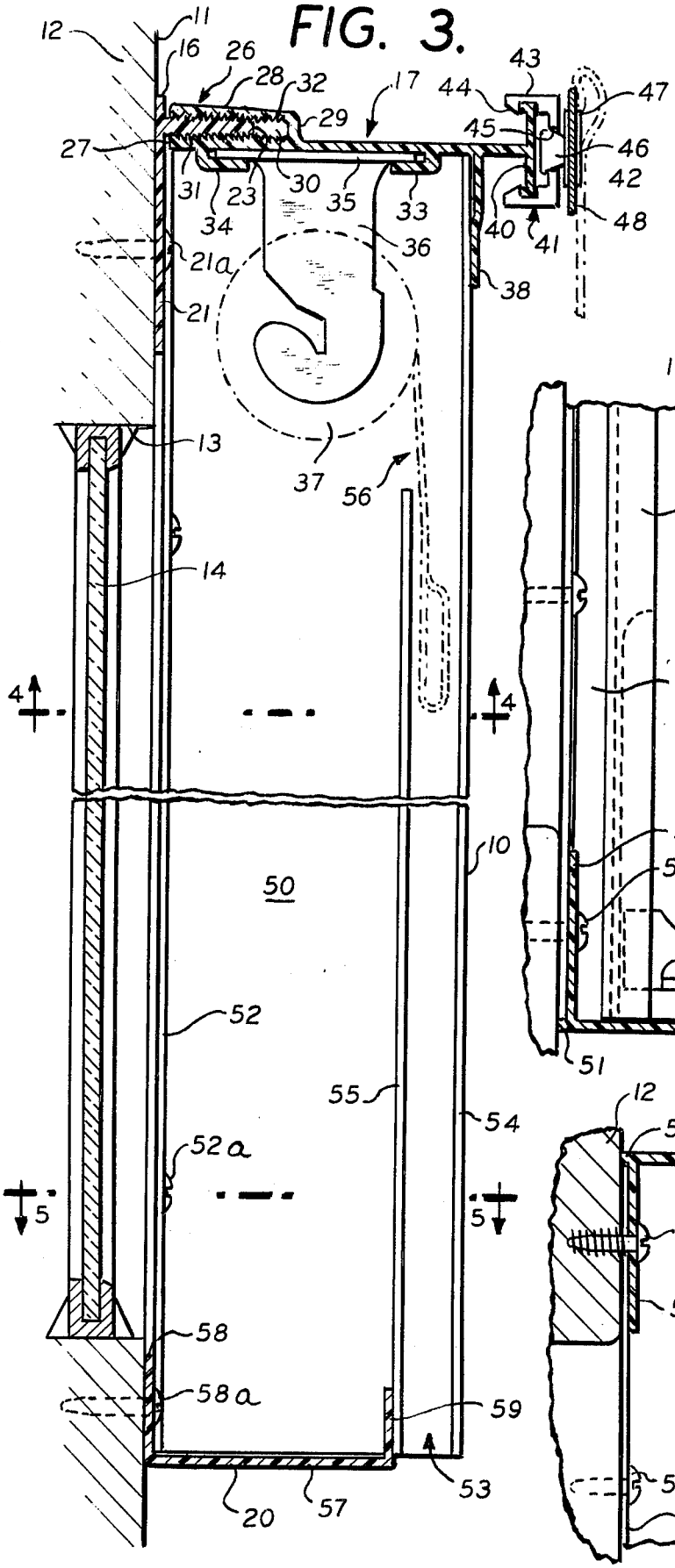
FIG. 3 is a vertical section view through the window trim assembly mounted on a building wall surrounding a window, taken along the line 3—3 of FIG. 1.

The head trim section 15, as is more clearly shown in FIGS. 2 and 3, is formed of the mounting base member 16 adapted to be fastened to the building wall 12, and an attachable front head trim member 17 is removably assembled with the mounting base extrusion 16 and is shaped to provide convenient facilities for supporting shade mounting brackets for roller type shades and for supporting a tape with snap fasteners or similar slide elements for mounting draperies or valances on the head trim section 15. In one embodiment, the mounting base extrusion 16 is of distorted T-shaped configuration providing a flat vertical base panel 21 which, for decorative purposes, may be provided with vertically spaced shallow horizontal V-grooves. The base panel 21 is adapted to be secured against the building wall by fasteners such as screws 21a. A mounting rib formation 23 integrally formed with the base panel 21 extends outwardly or forwardly therefrom at a location spaced slightly below the upper edge of the base panel. The mounting rib formation 23 has saw-tooth shaped lock shoulders or teeth 31 formed along the top and bottom surfaces of the mounting rib formation 23 collectively defining a series of trapezoidal clip lock ridges extending the length of the extrusion with the saw-tooth ridge biased towards the base panel 21.

The attachable front head trim extrusion 17 includes a generally horizontally extending main web forming the main body portion and terminating along its rearmost edge portion in a rearwardly opening locking channel formation 26 designed to receive and frictionally interlock with the mounting rib formation 23 of the mounting base 16. To this end, the locking channel 26 includes a lower channel side 27 lying in the plane of the remainder of the main web and constituting a rearward extension thereof and includes an upper channel side 28 joined to the main web by a leg 29 forming the base web of the channel and spacing the upper and lower channel sides 28 and 27 from each other an appropriate distance to define a channel recess 30 whose confronting side surfaces closely approximate, but may be spaced apart slightly less than the distance between the upper and lower surfaces of the mounting rib formation 23. The confronting channel side surfaces of the channel sides 27 and 28 are also shaped to provide saw-toothed shaped lock shoulders 32, with the inclined saw-tooth ridges facing towards the open end of the channel recess, that is opposite to the orientation of the saw-tooth ridges 31 of the rib 23, so as to frictionally interlock with the lock shoulders 31 of the mounting rib 23 when the mounting rib is inserted into the channel recess and the front head trim extrusion is forced rearwardly as far as it will go. Preferably the rear edges of the channel 26 are designed to abut against base panel 21 to provide for additional support and the length of the recess 30 exceeds the length of the rib 23. The plastic material, (e.g., ABS, PVC, polypropylene, etc.) from which the head trim sections 16 and 17 are formed has a slight but sufficient degree of flexibility over the extent of the relatively thin upper and lower channel sides 27, 28 so that they will be sufficiently yieldable to enable the attachable front head trim section 17 to be assembled onto the mounting base 16 in interlocked relation with the lock shoulders on the mounting rib 23.

Depending integrally from the main web are a pair of right-angle guide legs 33, 34 defining inwardly opening or confronting guide channels spaced apart an appropriate distance to slidably receive therein the opposite edges of the base portions 35 of a pair of conventional shade mounting brackets 36 for a conventional roller type shade, such as the shade 37. By providing the guide tracks defined by the channels of the right-angle guide legs 33, 34 which extend the length of the head trim extrusion section, the shade mounting bracket 36 can be slidably adjusted along the trackway therefore to space them to proper distance to receive the roller portion of the shade 37 therebetween.

Forwardly of the trackway defined by the guide legs 33, 34 is a depending front panel 38 integrally formed with the main web. The front panel 38 is spaced a short distance rearwardly of the front edge of the man web and forms with the lower portion of the base panel 21 of mounting base 16 a downwardly opening channel (FIG. 4) into which the roller portion of the shade 37 may be partially received when mounted on the mounting brackets 36. The forward edge portion of the main web terminates in a T-shaped flange 40 having legs or lips which extend upwardly and downwardly from the main web and provide a slide rail or track for a drapery or valance supporting facility. In the illustrated embodiment, the valance supporting facility is formed of a plurality of U-shaped flexible mounting clips 41 of channel shaped configuration each having a base web portion 42 and side legs 43 terminating at their free rear edges in substantially right-triangular cross sectioned inwardly projecting retaining lips 44 and formed of flexibly deformed plastic or rubber-like material or the like so that the sides 43 can be spread apart to receive the T-shaped flange or slide track 40 upon engagement of the inclined surfaces of the retaining lips 44 against the edges of the track and appropriate forcing of the mounting clips 41 rearwardly. The web portions 42 of the mounting clips 41 in the illustrated embodiment have circular sockets or openings 45 therein to receive and be frictionally coupled with tapered fastener heads 46 of snap fasteners 47 on a flexible tape 48 to which draperies, as indicated in 49 in FIG. 1, or valances, of fabric or similar sheet material can be stitched, adhesively secured or otherwise fastened. In this manner, draperies or valances can be readily mounted on the T-shaped track formation 40 at the forward edge of the head trim section 15 and the slide fastening clips 41 can be adjusted along the length of the track formation to shape the draperies or valances with pleats or loose folds to provide the desired decorative effect.

Figure 4:
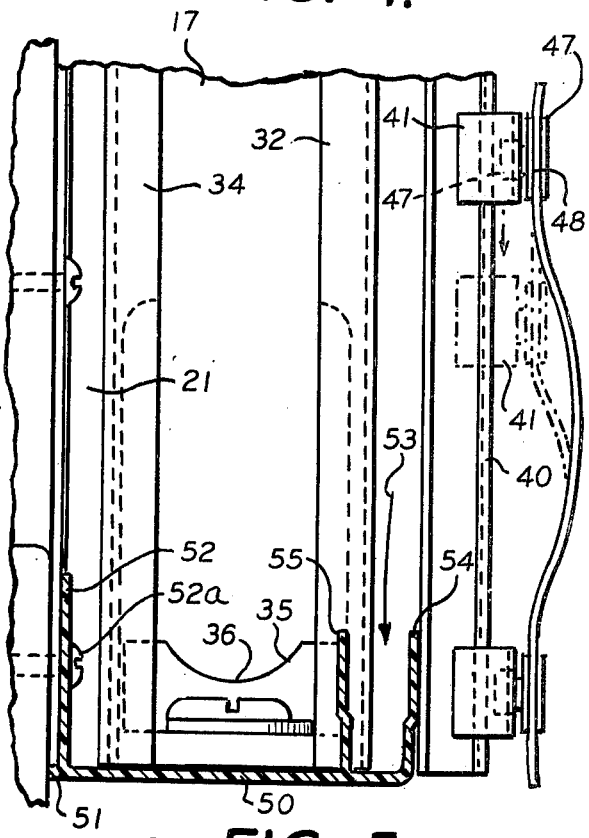
FIG. 4 is a fragmentary horizontal section view taken through one of the side jamb members of a plastic window trim assembly, taken along the line 4—4 of FIG. 3 and looking upwardly.
Figure 5:
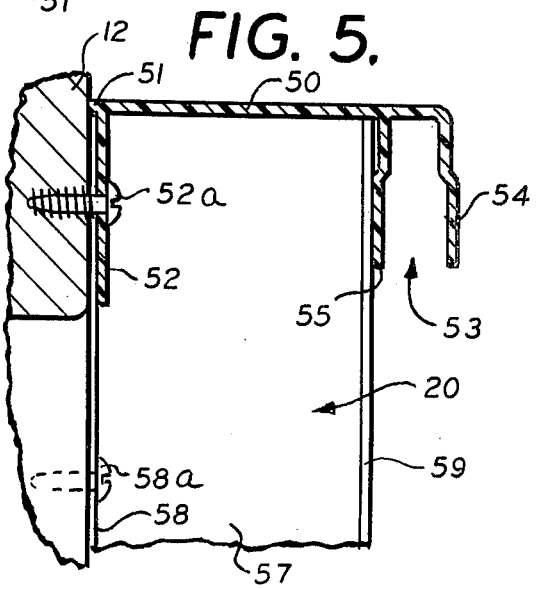
FIG. 5 is a fragmentary horizontal section view through the side jamb portion of the window frame assembly and looking downwardly, taken along the line 5—5 of FIG. 3.

The side or jamb trim members 18, 19, as will be apparent from inspection of FIGS. 2, 4 and 5, are of generally channel shaped configuration providing an outer base panel 50 having a rearmost edge 51 designed to butt against the building wall surface 11 adjacent the window opening and having a rear channel side or panel 52 spaced just inwardly from the rearmost edge 51 by a distance corresponding substantially to the thickness of the base panel 21 of the head trim mounting base 16 to outwardly overlie and abut the front surface of the head trim base panel 21 and be secured to the building wall by suitable fasteners such as screws 52*a*. At the forward end portion of the outer base panel 50 of each side or jamb trim member 18, 19 is a shade guide channel, indicated generally by the reference character 53, defined by a front channel side 54 and a rear channel side 55 both formed integrally with the base panel 50 and spaced apart a short distance to receive a side edge of the shade 37 and the thicker hem and reinforcing slat at the lower edge of the shade if one is provided. The rear side panel 55 of the shade guide channel is cut away, as indicated at 56 in FIG. 3, over an appropriate length at the upper end portion of the side or jamb trim members to accommodate the roller portion of the shade and to admit the shade web portion into the upper end portions of the guide channels 53.

The bottom or sill trim member 20 is a simple U-shaped channel extrusion formed of a base panel or web portion 57 having a width approximating the distance between the panels 52 and 55 of the side or jamb trim members, with a rear channel side member 58 and a front channel side member 59 extending upwardly from the rear and front edges of the base panel 57. The rear channel side member 58 is preferably of the same thickness as the base panel 21 of the head trim section 15 and, like the base panel 21, is designed to interfit between the rear channel wall 52 of the side or jamb members and the adjacent surface of the building wall 12 and be secured to the building wall by fastening screws 58*a* similar to the screws 52*a* and 21*a*.

It will be apparent that the plastic window trim assembly of the present invention can be readily shaped to the size of a window which is to be trimmed out by cutting the plastic mounting base and front head trim extrusions 16 and 17 and the bottom trim extrusion 20 to the proper lengths for the width of the window opening and cutting the side or jamb trim extrusion to provide side trim members 18 and 19 of appropriate height for the window opening, and cutting away the portion of the channel side panel 55 of the side trim members 18, 19 for appropriate distances at the upper end thereof to accommodate the shade.

The mounting base extrusion 16 can then be fastened to the building wall at the proper position by the fastening screws 21*a* extending through the mounting base panel 21, and the attachable front head trim extrusion 17 can then be readily assembled thereto by positioning the rearwardly opening channel recess 30 in alignment with the mounting rib 23 and forcing the front head trim extrusion 17 rearwardly to interfit the rib formation 23 in the channel recess 30 and interlock the lock shoulders 24 and 31, 32. The shade mounting brackets 36 can then be assembled in the guide tracks formed by the guide legs 33, 34, the side or jamb trim members 18, 19 which have been cut to proper length can then be interfitted at their upper ends between the base panel 21 and the front panel 38 of the head trim section and fastened to the building wall by the screws 52*a*, and the bottom trim member 20 cut to the appropriate length can then be positioned relative to the rear panel 52 and channel wall 55 in the manner illustrated in FIG. 3 and fastened to the building wall by screws 58*a*. Of course the lower screw or screws 52 a for the side trim members should not be tightened until the bottom trim extrusion has been assembled in position so that the lower portion of the side trim member rear panel 52 will not have been forced too close to the building wall surface to accomodate the rear flange 58 of the bottom trim extrusion 20 therebetween.

The alternate embodiment for head trim member 17 is shown in FIG. 6 a wherein downwardly extending rib 60 is used to mate with channel 62 in a fashion similar to that described for channel 26 and rib 23 (FIG. 3). Channel 62 releasably grips rib 60 in interlocked relation when inserted therein and carries slotted tubular member 64 for hanging a curtain such as a sheer liner. If desired the male-female relationship of ribs 23 and 60 and channels 26 and 62 can be reversed. T-shaped rail 40 extends at right angles from panel 38 for receiving curtain supporting elements as shown in FIG. 3. Forward rail 40' can be used for the same purpose or for mounting self-gripping curtain holders such as VELCRO tape and the like.

FIGS. 6*b* and *c* show modified slide clips 41 for use with any embodiment described herein which does away with the need for a tape 40 which is sewed to the top edge of a drape or curtain. As shown in FIGS. 6*b* and *c* the clips 41 have a downwardly extending member 80 with an aperture or hole 82 for receiving a drapery hanging pin or the like. The clips 41 are generally of semi-flexible plastic and are forced (snapped) over T-rails 40 and 40'.

FIGS. 7*a–c* show an end cap 70 suitable for the head trim shown in FIG. 6. Channel 72 has gripping ridges similar to channel 26 and grips the area between panel 38 and rail 40'.

FIG. 8*a* is similar to the front member of FIG. 6*a* but incorporates inverted T-rails 84 for supporting slide-roller members 86 (FIG. 8*b*) having rings for receiving drapery pins and the like. Also, rib 60 can interlock with channel 62 formed with roller mounting member 36 similar to that shown in FIGS. 1–5.

FIGS. 8*c* and *d* show an end cap for use with the assembly of FIG. 8 a which is similar to the end cap of FIG. 7 but differs in that channel 72 is adapted to grip panel 38 to cover the rear end section of the assembly. Holes 74 in the cap 70 are for receiving drapery pins or the like for wrapping a drapery around the end of the assembly for a neat, snug fit against the wall or window frame.

FIGS. 9*a–c* show an end cap 90 with a rib 92 with gripping edges for insertion into roller shade channel 33, 34 of FIGS. 1–5. This is in lieu of side jambs 18 and 19 and end caps 70 of FIGS. 7 and 8*c–d* can also be used with the embodiment of FIGS. 1–5.

FIG. 10 shows channel 26 with a series of ridges 94 and valleys 94' along the interior length thereof. These interlock releasably with similar ridges 94 and 94' on the mounting rib 23 of the base member. Channel 26 is designed to be flexible enough to spread apart during insertion of the rib 23. Roller mounting channels 33 and 34 and front panel 38 complete the assembly.

The ridges and valleys 94 and 94' are adapted to mount exterior window trims on recreational vehicles and the like. The interlock is releasable which means that the mounting base member can be attached over a window opening and when the vehicle is parked, the front assembly with a thermal shade can easily be installed by hand without tools or additional fasteners such as bolts or screws. The assembly is tilted down slightly for water run-off. The configuration of the ridges and valleys 94 and 94' is such that the front head trim can easily be pulled off before driving the vehicle. The saw-tooth interlock shown between channel 26 and rib 23 in FIGS. 1–5 is more permanent but can be withdrawn laterally or sideways by removing the side jamb or end cap.

It will be appreciated that the valance, curtain or drapery supporting means shown in the drawings can be interchanged and/or combined among the various front trim members shown.

A suitable exterior shade for the exterior trim of FIG. 10 can be woven from PVC coated polyester fiber and a reflecting coating of aluminum can be applied to the exterior. This provides a see-through shade that reflects 60 to 93% of the sunlight thus providing an effective thermal barrier.

Figure 11:
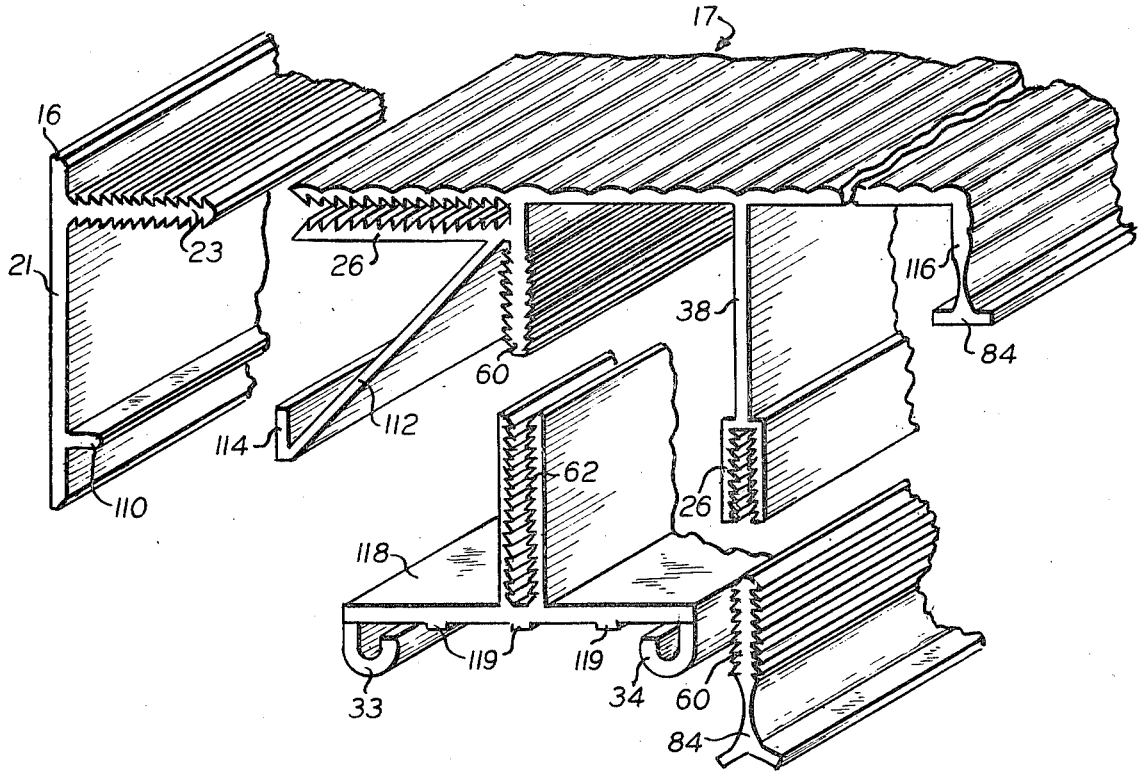
FIG. 11 is a perspective end view partly broken away of an alternate embodiment with respect to the window trim assembly of the invention showing the base member exploded from the front member and shade and curtain mounting elements exploded from the front member.

A preferred embodiment for the window trim assembly is shown in FIG. 11 wherein downwardly extending rib 60 is used to mate with channel 62 in a fashion similar to that described for channel 26 and rib 23 (FIG. 3). Channel 62 grips rib 60 in interlocked relation when inserted therein and carries a right angle member 118 with downwardly and inwardly extending members 33 and 34 which together with the rib members 119 form a channel for receiving shade mounting brackets therein similar to that shown and described with respect to FIGS. 1–3 herein. Panel number 38 extends down from the head trim member 17 and terminates in a downwardly opening channel 26 which is adapted to receive the upwardly extending rib 60 of the roller curtain mounting element 84. The engagement between rib 60 and channel 26 is basically the same as that previously described.

In the front of the trim member 17 is a downwardly extending member 116 which terminates in a roller supporting member 84 which is similar to the embodiment shown in FIG. 8*a*.

As shown in FIG. 11, the head trim member 17 preferably includes a rearwardly inclined supporting member 112 which engages the base member 16 when the head trim member 17 is mounted on the base. Preferably the rearwardly inclined member 112 terminates in an upwardly turned portion 114 and is adapted to rest on the horizontal ridge or rib 110 formed on the base 21 of the mounting base member 16.

Thus, the main body portion of the head trim member 17 can include one or more downwardly extending mounting ribs or corresponding channels and the trim assembly can include supporting means having a corresponding upwardly extending channel or mounting rib and the supporting means are adapted to support valance, shade or curtain mounting elements as shown and described herein. FIG. 11 shows an embodiment wherein separate shade and curtain mounting elements are interlocked with the head trim member 17 in the same fashion as the head trim member itself is mounted to the mounting base member.

Figure 12:
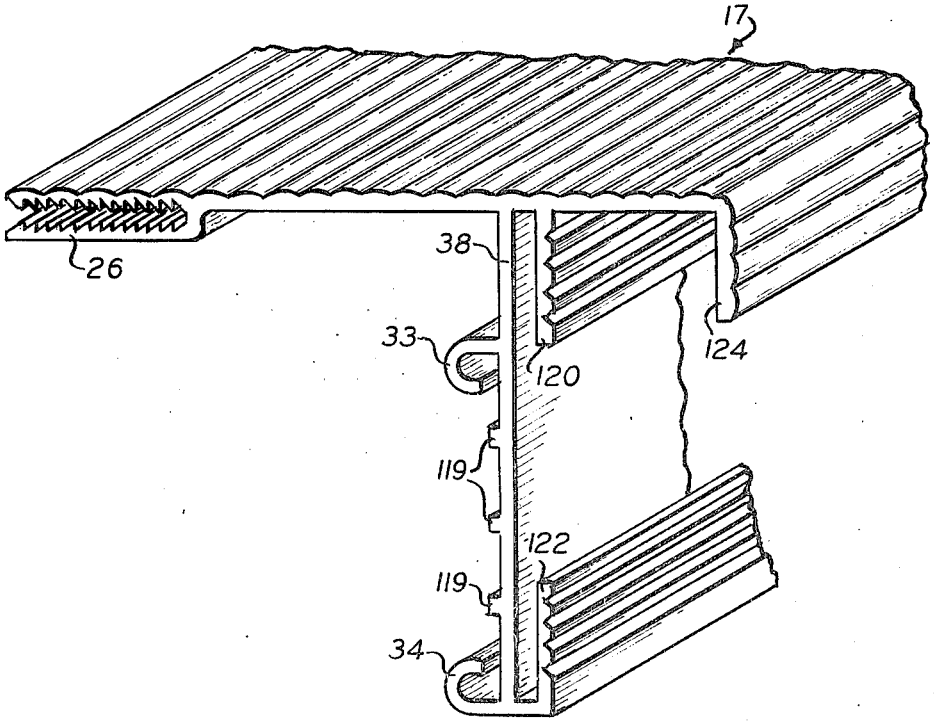
FIG. 12 is a perspective end view partly broken away of an alternate embodiment with respect to the front member of the window trim assembly of the invention.

In FIG. 12, a downwardly extending panel number 38 is shown to include a rearwardly opening channel similar to that shown in FIG. 11 for receiving at least a portion of a roller type shade in mounted relation therein. The downwardly extending panel 38 can terminate or end in an outwardly and upwardly turned panel member 122 which can be adapted to support valance or curtain mounting elements in a fashion described previously with respect to member 40'. FIG. 12 also includes a downwardly extending panel member 120 which again can be used to support valance or curtain mounting elements in a fashion similar to that described for member 40'. The head trim member can terminate in a downwardly extending panel member 124 for improving the appearance or for supporting valance or curtain mounting elements in a fashion similar to that described for members 120 and 122.

A further energy saving feature of this invention which is especially suitable for use with existing windows and doors involves providing jamb trim members 18 and 19 (FIGS. 1–3) with means to accommodate a clear glass or plastic panel to cover the window and thereby provide an effective insulating air space therebetween. This can be done by providing side channels, similar to channels 53 for the shade 37 on the inside of each jamb member 18 and 19, preferably using side panels 52 for the rear portion of the channel so as to locate the glass or plastic panel in a tight covering position over the window. Bottom trim member 20 can also have a similar channel for better sealing. Such a panel can be inserted and removed (for warmer weather) by pulling off or sliding out the head trim member 15 or the side member 18 and 19 or the base member 20 can be modified for removal of the glass or plastic panel, for example by providing exterior mounting flanges or tabs for members 18, 19 or 20 on the window or window frame.

What is claimed is:

1. Window head trim assembly comprising a mounting base member and a front head trim member attachable thereto, said mounting base member having a base portion positionable vertically for mounting against a window frame head or wall, said front head trim member having a generally flat main body panel portion positioned, when attached, in a horizontal plane and adapted to support at least one of valance, shade or curtain mounting elements, and means for attaching the trim member to the base member, with its base portion vertically disposed, in response to only horizontal movement of the trim member with its main body portion horizontally disposed, said means for attaching comprising (i) a single, substantially flat mounting rib portion having a series of ridges along the length thereof, said rib portion being integral with the base portion of the base member and projecting horizontally outwardly therefrom; and (ii) a rearwardly opening, horizontally disposed, U-shaped channel integral with the trim member having a corresponding series of ridges along the interior length thereof for gripping the mounting rib portion of the mounting base portion in interlocked relation when inserted therein.

2. Trim assembly of claim 1 wherein said front head trim member has a T-shaped front flange portion integral with and at the front edge of said main body panel portion defining a rail for supporting valance or curtain supporting elements thereon.

3. Trim assembly of claim 1 wherein said front head trim member includes a downwardly opening channel for receiving at least a portion of a roller type shade in mounted relation therein.

4. Trim assembly of claim 1 including a pair of side jamb trim members each having a rear flange portion adapted to be fastened to a window frame or wall.

5. Trim assembly of claim 4 including a bottom trim member which together with the side jamb trim members form a rectangular surround about a window opening.

6. Trim assembly of claim 1 wherein said main body panel portion has integral downwardly extending right-angle guide legs facing each other defining guide recesses for slidably receiving edge portions of roller shade mounting brackets and supporting same against the underside of said main body panel portion.

7. Trim assembly of claim 1 wherein end caps are provided with ribs with gripping means for insertion into the guide recesses at each end of the head trim member.

8. Trim assembly of claim 1 wherein the mounting rib portion has a series of saw-toothed shaped ridges extending along parallel paths along the length thereof and the inner facing surfaces of said channel of said front head trim member include similar saw-toothed shaped ridges extending along parallel paths along the length thereof to interlock with the ridges of the mounting rib portion when the latter is inserted to said channel, said channel sides being slightly flexible so as to allow separation of the channel sides during insertion of the mounting rib portion and interlocking of the confronting saw-toothed ridges.

9. Trim assembly of claim 1 wherein the mounting rib has a series of ridges and valleys extending along the length thereof and the inner facing surfaces of said channel of said front head trim member include similar ridges and valleys extending along the length thereof to interlock with the ridges and valleys of the mounting rib portion when the latter is inserted in said channel, said channel sides being slightly flexible so as to allow separation of the channel sides during insertion of the mounting rib portion and interlocking of the confronting ridges.

10. Trim assembly of claim 4 wherein said side jamb trim members each have a pair of vertical channel forming panels which define shade guide channels along the height of the side jamb trim members for receiving the opposite lateral edges of a roller shade therein, the rearmost one of said channel panels being interrupted for a predetermined distance near the top of the side jamb trim members for passage of the edge portions of the shade into the shade guide channels.

11. Trim assembly of claim 1 wherein the main body portion of the head trim member has a downwardly extending mounting rib and the assembly includes supporting means having an upwardly opening channel having means therein for gripping said downwardly extending mounting rib in interlocked relation when inserted therein, said supporting means being adapted to support volume, shade or curtain mounting elements.

12. Trim assembly of claim 11 wherein the curtain supporting element is a slotted tubular member.

13. Trim assembly of claim 1 wherein said front head trim member has a downwardly extending front panel forward of said channel which ends in a T-shaped front flange defining a rail for supporting valance or curtain supporting elements thereon.

14. A plastic window trim structure formed of extruded plastic to be mounted on the inside surface of a building wall adjacent a window opening therein, comprising a head trim section to be located in a horizontal position across the top of the window opening formed of a mounting base extrusion and an attachable front head trim extrusion assembled thereon, the mounting base extrusion having a flat planiform base panel to be positioned vertically and mounted against the inside surface of the building wall, and the attachable front head trim extrusion having a generally planiform main body panel portion adapted to be located in a horizontal plane in the assembled window trim assembly and means for attaching the trim extrusion to the base extrusion, with its base panel vertically disposed, in response to only horizontal movement of the trim extrusion with its main body panel horizontally disposed, said means comprising and a single mounting rib formation having a series of ridges along the length thereof, said rib formation being integral with the base extrusion and projecting forwardly and horizontally therefrom and an attaching horizontally disposed channel formation integral with the head trim extrusion defining a rearwardly opening channel recess having a corresponding series of ridges along the interior length thereof to receive said mounting rib formation of the mounting base extrusion in releasably interlocked relation therein, the front head trim extrusion further having a T-shaped flange formation integral with and at the front edge of said main body panel portion defining a slide rail for releasably assembling valance or curtain supporting elements thereon, and said front head trim extrusion further including means coactive with said base panel of said mounting base extrusion defining a downwardly opening channel for receiving at least a portion of a roller type shade in mounted relation therein.

15. Trim assembly of claim 1 wherein the base portion includes a horizontally disposed member projecting outwardly therefrom and spaced from the mounting rib and parallel thereto and said head trim member includes a rearwardly inclined supporting member which engages the horizontally disposed projecting member of the base portion of the mounting base member.

16. Trim assembly of claim 1 wherein the main body portion of the head trim member has a downwardly opening channel and the assembly includes supporting means having an upwardly extending mounting rib, said channel having means therein for gripping said mounting rib in interlocked relation when inserted therein, said supporting means being adapted to support valance, shade or curtain mounting elements.

17. Trim assembly of claim 1 wherein the main body portion of the head trim member has a downwardly extending panel forward of said channel, said panel having a rearwardly opening channel for receiving at least a portion of a roller type shade in mounted relation therein.

18. Trim assembly of claim 17 wherein the downwardly extending panel ends in an outwardly upturned panel member adapted to support valance or curtain mounting elements.

19. Trim assembly of claim 5 wherein the side trim members have means to accommodate a glass or plastic panel which covers the window thereby providing an insulating air space therebetween.

* * * * *